US005176077A

United States Patent [19]

DeMoore et al.

[11] Patent Number: 5,176,077

[45] Date of Patent: Jan. 5, 1993

[54] COATING APPARATUS FOR SHEET-FED, OFFSET ROTARY PRINTING PRESSES

[75] Inventors: Howard W. DeMoore, 2552 Royal La., Dallas, Tex. 75229; David D. Douglas, Garland; Steven M. Person, Seagoville, both of Tex.

[73] Assignee: Howard W. DeMoore, Dallas, Tex.

[21] Appl. No.: 752,778

[22] Filed: Aug. 30, 1991

[51] Int. Cl.[5] ..... B41F 9/00

[52] U.S. Cl. ..... 101/142; 101/147; 101/232; 101/348; 118/46

[58] Field of Search ..... 101/135, 424.1, 142, 101/148, 155, 157, 177, 217, 232, 246, 329, 330, 331, 408, 409, 419, 422, 348-349; 118/46, 211, 236, 249, 257, 258, 261, 262, 263, 206, DIG. 15

[56] References Cited

U.S. PATENT DOCUMENTS

| | | | |
|---|---|---|---|
| 4,270,483 | 6/1981 | Butler et al. | 118/46 |
| 4,372,244 | 2/1983 | Rebel | 118/46 |
| 4,399,767 | 8/1983 | Simeth | 118/46 |
| 4,402,267 | 9/1983 | DeMoore | 101/419 |
| 4,524,712 | 6/1985 | Ito | 118/46 |
| 4,685,414 | 8/1987 | DiRico | 118/46 |
| 4,704,296 | 11/1987 | Leanna et al. | 427/9 |
| 4,706,601 | 11/1987 | Jahn | 118/46 |
| 4,779,557 | 10/1988 | Frazzitta | 118/46 |
| 4,796,556 | 1/1989 | Bird | 118/46 |
| 4,821,672 | 4/1989 | Bruno | 118/261 |
| 4,841,903 | 6/1989 | Bird | 118/46 |
| 4,848,265 | 7/1989 | Komori | 118/46 |
| 4,895,070 | 1/1990 | Bird | 101/148 |
| 4,919,048 | 4/1990 | Tyler | 101/217 |
| 4,934,305 | 6/1990 | Koehler | 118/46 |
| 4,939,992 | 7/1990 | Bird | 101/183 |
| 4,977,828 | 12/1990 | Douglas | 101/142 |
| 5,088,404 | 2/1992 | MacConnell et al. | 101/232 |
| 5,127,329 | 7/1992 | DeMoore et al. | 101/232 |

FOREIGN PATENT DOCUMENTS

| | | | |
|---|---|---|---|
| 0270054 | 6/1988 | European Pat. Off. | 101/419 |
| 2151185 | 7/1979 | Fed. Rep. of Germany | 101/424.2 |

*Primary Examiner*—Eugene H. Eickholt
*Attorney, Agent, or Firm*—Dennis T. Griggs

[57] ABSTRACT

A coating apparatus for use in a sheet-fed, offset rotary printing press to selectively apply a protective and/or decorative coating to the wet ink surface of freshly printed sheets and including a coating unit having a pick-up roller for supplying aqueous coating material from a reservoir to the surface of a delivery cylinder mounted on a press delivery drive shaft, the delivery cylinder performing the dual function of a coating applicator roller and a delivery cylinder during coating operations.

22 Claims, 5 Drawing Sheets

FIG. 4
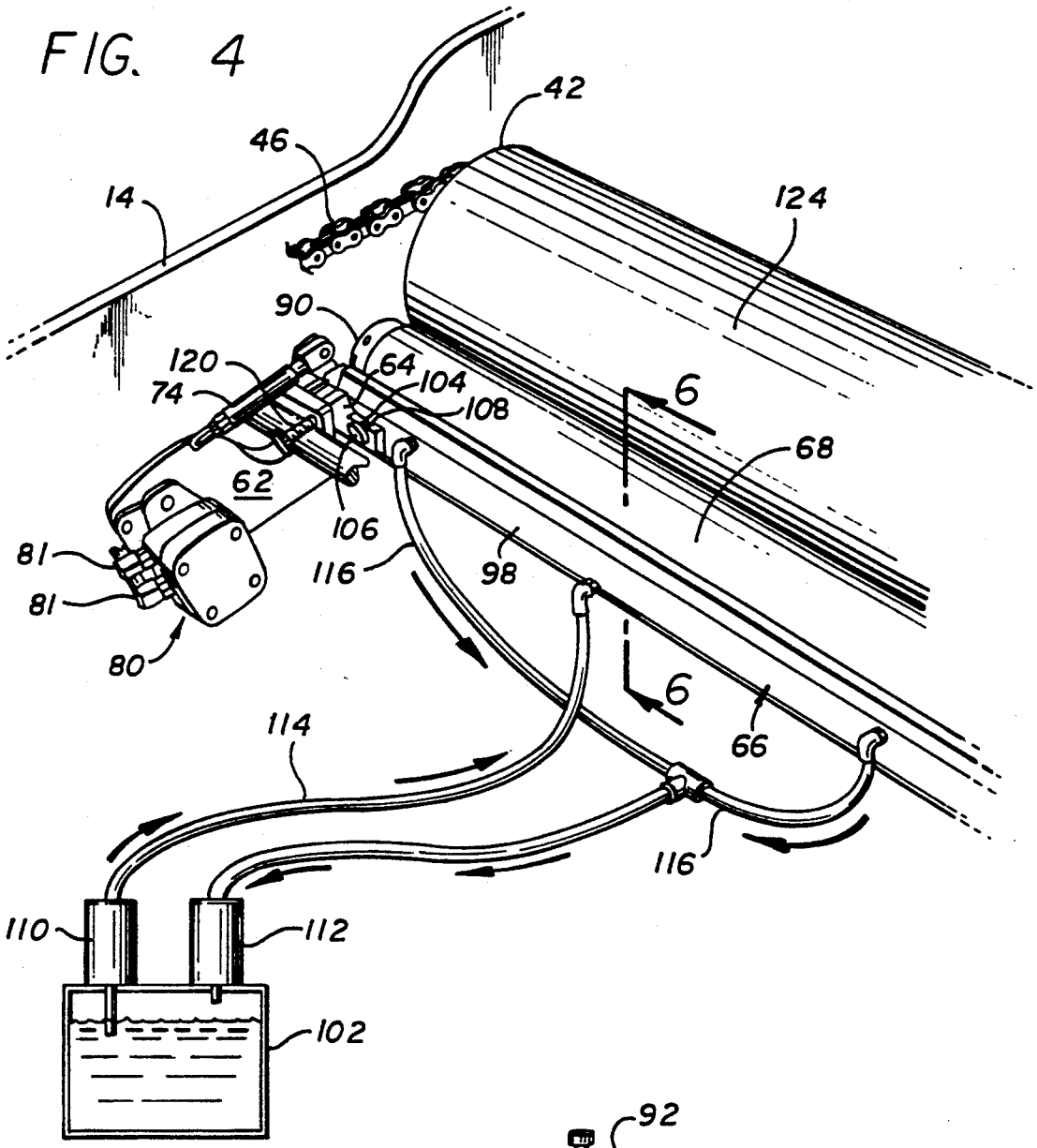
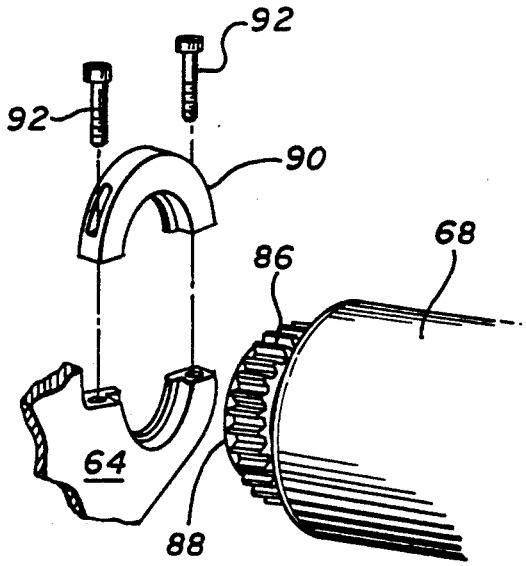
FIG. 5

COATING APPARATUS FOR SHEET-FED, OFFSET ROTARY PRINTING PRESSES

BACKGROUND OF THE INVENTION

This invention relates to sheet-fed, offset rotary printing presses, and more particularly, to a new and improved apparatus for the in-line application of protective and decorative coatings to the printed surface of freshly printed sheets.

Conventional sheet-fed, offset rotary printing presses typically include one or more printing stations through which individual sheets are fed and printed with wet ink. After final printing, the sheets are fed by a delivery conveyor system to the delivery end of the press where the freshly printed sheets are collected and stacked. In a typical sheet-fed, offset rotary printing press such as the Heidelberg Speedmaster line of presses, the delivery conveyor system includes a pair of endless gripper chains carrying laterally spaced gripper bars and grippers which are used to grip and pull freshly printed sheets from the impression cylinder and convey the sheets toward the sheet delivery stacker. The gripper chains are driven in precisely timed relation to the impression cylinder by gripper chain sprocket wheels laterally spaced between a delivery drive shaft mounted on opposite sides of the press frame, the delivery drive shaft being mechanically coupled by gears for synchronous rotation with the impression cylinder.

Since the inks used with offset type printing presses typically remain wet and tacky for some time after printing, special precautions must be taken to insure that the wet inked surface of the freshly printed sheets are not marked or smeared as the sheets are transferred from one printing station to another, and through the delivery system to the sheet delivery stacker. One system for insuring that the freshly printed sheets are not marked or smeared during transfer is the transfer or delivery cylinder system marketed by Printing Research, Inc., of Dallas, Texas under its registered trademark "SUPER BLUE" That system, which is made and sold under license, is made in accordance with and operates as described in U.S. Pat. No. 4,402,267, issued Sep. 6, 1983 to Howard W. DeMoore, the disclosure of which is incorporated herein by this reference. In that system, marking and marring of freshly printed sheets is prevented by employing transfer or delivery cylinders provided with a coating of friction reducing material such as PTFE (Teflon) over which are loosely mounted fabric covers, referred to in the trade as "nets", and which support the wet ink side of the freshly printed sheets as they are pulled from the impression cylinder. Typically, in a multi-color press employing the "SUPER BLUE" cylinder system, each transfer cylinder for conveying the freshly printed sheets from one printing station to the next is supplied with a "SUPER BLUE" transfer cylinder system, and the delivery cylinder for conveying the sheets from the last printing station to the sheet delivery stacker is supplied with a "SUPER BLUE" delivery cylinder system. As used hereinafter, the term "net type cylinder" is intended to refer to cylinders having fabric nets disposed over the support surface, such as of the general type disclosed in the aforementioned DeMoore U.S. Pat. No. 4,402,267 and exemplified by the "SUPER BLUE" cylinder system.

Another system which can be used to prevent marking and smearing of the freshly printed sheets is that disclosed in U.S. application Ser. No. 07/630,308 filed Dec. 18, 1990 entitled Vacuum Transfer Apparatus for Sheet-Fed Printing Presses now U.S. Pat. No. 5,127,329. That application, the disclosure of which is also incorporated herein by reference, discloses an apparatus which can be employed to draw the unprinted side of a freshly printed sheet into engagement with rollers which support the sheet on the unprinted side during transfer or delivery of the sheet from the impression cylinder after printing so that the wet ink on the freshly printed sheet does not come in contact with other apparatus in the press. The vacuum transfer apparatus disclosed in that application can be used as an alternative to the net type cylinder system disclosed in the aforementioned DeMoore patent, or when used in a perfecting press, as a supplement to that system, the vacuum transfer apparatus being primarily intended for use when only one-sided sheet printing is being performed by the press, and the net type cylinder system being used when the press is operating in the perfector mode with two-sided sheet printing.

In some printing applications, it is desirable that the press be capable of applying a protective and/or decorative coating over all or a portion of the surface of the printed sheets. Such coatings typically are formed of a UV-curable or water-soluble resin applied as a liquid solution or emulsion by an applicator roller over the freshly printed sheets to protect the ink and improve the appearance of the sheets. Use of such coatings is particularly desirable when decorative or protective finishes are required such as in the production of posters, record jackets, brochures, magazines, folding cartons and the like. In cases where a coating is to be applied, the coating operation is carried out after the final ink printing has been performed, most desirably by an in-line coating application, rather than as a separate step after the printed sheets have been delivered to the sheet delivery stacker.

Various suggestions have been made for applying the coating as an in-line press operation by using the final printing station of the press as the coating application station. For example, in U.S. Pat. Nos. 4,270,483, 4,685,414, and 4,779,557 there are disclosed coating apparatus which can be moved into position to allow the blanket cylinder of the last printing station of a press to be used to apply a coating material to the sheets. In U.S. Pat. No. 4,796,556 there is disclosed a coating apparatus which can be selectively moved between the blanket cylinder or the plate cylinder of the last printing station of the press so that that station can be used as a coating station for the press. However, when coating apparatus of these types are used, the last printing station can not be used to apply ink to the sheets, but rather can only be used for the coating operation. Thus, with these types of in-line press coating apparatus, the press loses the capability of printing its full range of colors since the last printing station is converted to a coating station.

Suggestions for overcoming the problem of the loss of a printing station when coating is desired have also been made, such as that set forth in U.S. Pat. Nos. 4,934,305 which discloses a coating apparatus having a separate timed applicator roller positioned to apply the coating material to the printed sheet while the sheet is on the last impression cylinder of the press. This is said to allow the last printing station to be operated simultaneously as both an ink application station and a coating station so that no loss of press printing unit capability results. Another approach to providing a coating station without loosing the printing capabilities of the last printing station is to provide a totally separate coating unit down stream of the last printing station so that the coating is applied to the sheets after final printing and before the sheets have reached the sheet delivery stacker. Such an approach is suggested in U.S. Pat. Nos. 4,399,767 and 4,706,601. While each of these suggestions provide coating stations which allow the final printing station to continue to be used for printing, they each suffer from the disadvantages of requiring the provision of separately driven coating applicator rollers and apparatus which must be precisely timed in relation to the movement of the sheet to be coated so as to insure precise registration between application of the coating material and the printed sheet. The provision of separate timed applicator rollers require that the presses be modified to provide sufficient space within the presses to accommodate the added coating apparatus or to increase the length of the presses, and require additional and complex drive connections with the press drive system to achieve the required precise speed correlation between the sheets and the applicator rollers. Such modifications can be both expensive and cumbersome to install and maintain.

Thus, there exists a need for a new and improved in-line apparatus for use in a sheet-fed, offset rotary printing press to selectively apply a protective and/or decorative coating to the printed surface of freshly printed sheets which allows the final press printing station to continue to be used as a printing station, yet which does not require any substantial press modification or the addition of a separate timed applicator roller. As will be explained in more detail hereinafter, the present invention solves this need in an novel and unobvious manner.

SUMMARY OF THE INVENTION

The present invention provides a new and improved in-line apparatus for selectively applying a protective and/or decorative coating to the surface of freshly printed sheets in a sheet-fed, offset rotary printing press which is highly reliable and effective in use, yet which does not require any expensive or substantial press modification or result in any impairment of normal press operating capability. The present invention enables the press to be used to selectively apply the coating material to the freshly printed sheets as the sheets are conveyed from the impression cylinder of the last printing station of the press toward the sheet delivery stacker by utilizing a delivery cylinder mounted to the existing press delivery drive shaft to perform the dual function of a coating material applicator roller and a sheet delivery cylinder so that no modification of the press is required to enable the press to be used for either coating or noncoating operation, and without impairment of any normal press operations.

More specifically, the present invention is intended for use in a sheet-fed, offset rotary printing press of the type having at least one printing station which includes a blanket cylinder and an impression cylinder disposed for printing ink onto sheets passing therebetween, and a delivery conveyor system for pulling freshly printed sheets off the impression cylinder and transporting the sheets toward the press sheet delivery stacker. For use of the present invention, the press must include a delivery drive shaft disposed adjacent to and extending parallel with the impression cylinder, and which is driven in timed synchronous relation with the impression cylinder.

In accordance with the invention, a delivery cylinder is mounted to the delivery drive shaft and provided with a coating blanket disposed over the peripheral outer surface of the cylinder, and adapted to engage and support the wet ink side of a freshly printed sheet. A coating apparatus including a supply of liquid coating material and a pick-up roller disposed to receive coating material from the supply, is mounted to the press and operable to permit the pick-up roller to be moved into engagement with the delivery cylinder so that coating material on the pick-up roller is transferred to the coating blanket of the delivery cylinder and then to the freshly printed sheet.

Preferably, the coating apparatus is mounted to the press downstream of the delivery drive shaft, and includes means to selectively move the pick-up roller into and out of engagement with the delivery cylinder. When the pick-up roller is not in the operable position in engagement with the delivery cylinder, the delivery cylinder can be used for conventional noncoating sheet delivery by removing the coating blanket and, preferably, replacing the coating blanket with a fabric net such as of the net type cylinder system previously described. To convert to a coating operation, the coating blanket is attached to the delivery cylinder and, depending upon the thickness of the sheets to be printed, packed with suitable packing sheets to increase the effective diameter of the cylinder so that pressure is applied to the freshly printed sheets against the impression cylinder by the coating blanket covered delivery cylinder. The pick-up roller is then moved to the operative position engaged with the delivery cylinder so that as freshly printed sheets are pulled by the delivery conveyor from the impression cylinder around the delivery cylinder, coating material applied to the delivery cylinder by the pick-up roller is transferred to the freshly printed sheets in the nip between the delivery cylinder and the impression cylinder.

Since the delivery cylinder is driven by the delivery drive shaft in precise timed relation with the impression cylinder, exact registration between the application of coating material and the printed sheet is assured. Further, since the coating of the freshly printed sheets is carried out through use of a delivery cylinder mounted to the existing press delivery drive shaft, no substantial press modifications are required, and the press can be quickly and easily converted between coating and noncoating operation with no loss of printing capability of the final printing station.

Many other features and advantages of the present invention will become more apparent from the following detailed description take in conjunction with the accompanying drawings which disclose, by way of example, the principles of the invention.

BRIEF DESCRIPTION OF THE DRAWINGS

FIG. 4 is an enlarged fragmentary perspective view showing one side of the coating apparatus mounted in the press and illustrating the fluid path of coating material from a supply tank to the reservoir of the coating unit;

FIG. 5 is an enlarged fragmentary perspective view illustrating the end mounting of the coating pick-up roller to its support bracket.

DETAILED DESCRIPTION OF PRESENTLY PREFERRED EMBODIMENT

Figure 1:
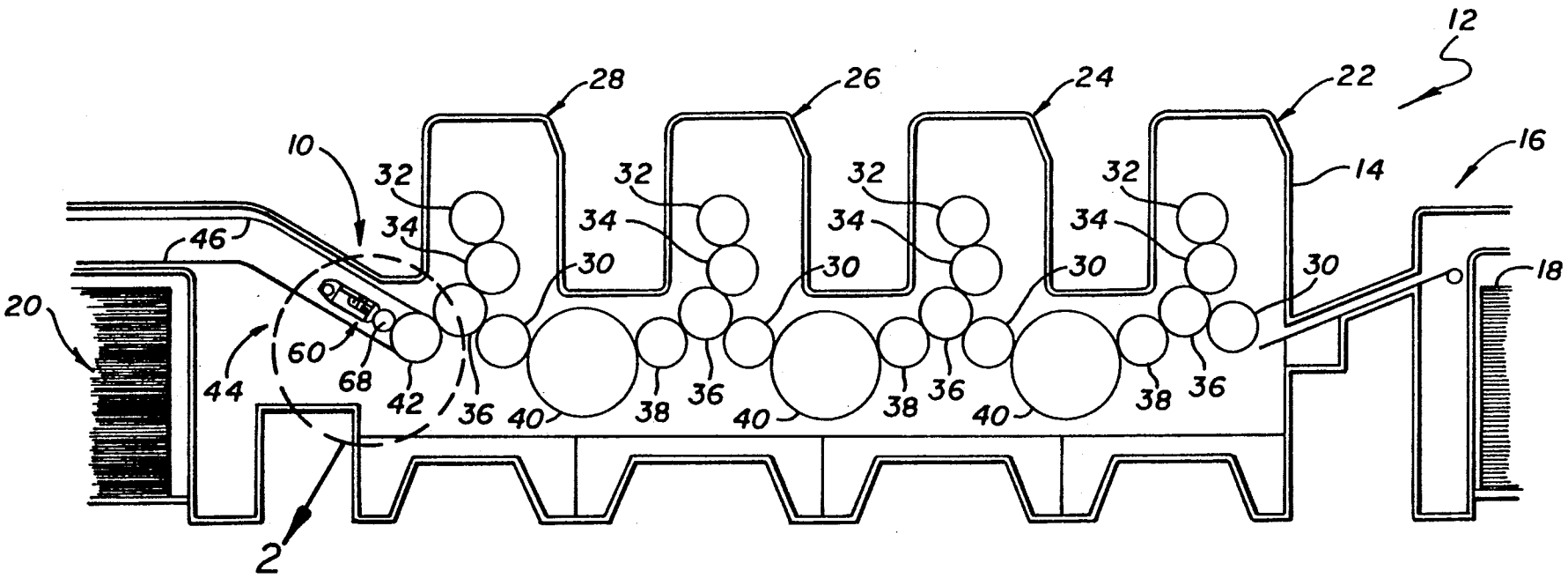
FIG. 1 is a schematic side elevational view of a sheet-fed, offset rotary printing press having a coating apparatus embodying the present invention.

As shown in the exemplary drawings, the present invention is embodied in a new and improved in-line apparatus, herein generally designated 10, for selective use in applying a protective and/or decorative coating to the freshly printed surface of sheets printed in a sheet-fed, offset rotary printing press, herein generally designated 12. In this instance, as shown in FIG. 1, the coating apparatus 10 is illustrated as installed in a four color printing press 12, such as that manufactured by Heidelberger Druckmaschinen AG of the Federal Republic of Germany under its designation "Heidelberg Speedmaster 102V (40")," and which includes a press frame 14 coupled at one end, herein the right end, with a sheet feeder 16 from which sheets, herein designated 18, are individually and sequentially fed into the press, and at the opposite end, with a sheet delivery stacker 20 in which the finally printed sheets are collected and stacked. Interposed between the sheet feeder 16 and the sheet delivery stacker 20 are four substantially identical sheet printing stations 22, 24, 26 and 28 which can print different color inks onto the sheets as they are moved through the press 10.

As illustrated, each of the printing stations 22, 24, 26 and 28 is substantially identical and of conventional design, herein including a sheet feed cylinder 30, a plate cylinder 32, a blanket cylinder 34 and an impression cylinder 36, with each of the first three printing stations 22, 24, and 26 having a transfer cylinder 38 disposed to withdraw the freshly printed sheets from the adjacent impression cylinder and transfer the freshly printed sheets to the next printing station via a transfer drum 40. The final printing station 28 herein is shown as equipped with a delivery cylinder 42 which functions to support the printed sheet 18 as it is moved from the final impression cylinder 36 by a delivery conveyor system, generally designated 44, to the sheet delivery stacker 20.

The delivery conveyor system 44 herein is of conventional design and includes a pair of endless delivery gripper chains 46, only one of which is shown in the drawings, carrying at regular spaced locations along the chains, laterally disposed gripper bars 48 having gripper elements 50 used to grip the leading edge of a sheet 18 after it leaves the nip between the delivery cylinder 42 and impression cylinder 36 of the last printing station 28. As the leading edge of the sheet 18 is gripped by the grippers 50, the delivery chains 46 pull the sheet away from the impression cylinder 36 and convey the freshly printed sheet to the sheet delivery stacker 20 where the grippers release the finally printed sheet. The endless delivery chains 46 are driven in synchronous timed relation to the impression cylinder 36 by sprocket wheels 52 fixed adjacent the lateral ends of a delivery drive shaft 54 which has a mechanically geared coupling (not shown) through the press drive system to the impression cylinder. The delivery drive shaft 54 extends laterally between the sides of the press frame 14 adjacent the impression cylinder 36 of the last printing station 28, and is disposed to be parallel with the axis of the impression cylinder. In this instance, the delivery cylinder 42, which is constructed to allow adjustments in diameter by suitable means, is fixedly mounted to the delivery drive shaft 54 so that the delivery cylinder is also rotated in precise timed relation to the impression cylinder.

Preferably, each of the transfer cylinders 38 is equipped with an anti-marking system such as the aforementioned net type transfer cylinder system or the press 12 can be supplied in the transfer positions with vacuum transfer systems of the type disclosed in the above-identified copending U.S. application Ser. No. 07/630,308 filed Dec. 18, 1990, although as will become more apparent hereinafter, the use of such transfer systems is not required for the present invention and other types of transfer systems can be used. For reasons that will become more apparent hereinafter, for most effective use of the present invention, however, the delivery cylinder 42 should be of the type which employs the "SUPER BLUE" delivery cylinder system, or, as an alternative, should employ in the delivery position, a vacuum transfer system such as disclosed in the above-identified copending U.S. application Ser. No. 07/630,308.

In this respect, it is important to note that when the freshly printed sheets 18 are conveyed away from the impression cylinder 36 of the final printing station 28 by the gripper 50 carried by the delivery chains 46, the wet inked surfaces of the sheets face the delivery drive shaft 54 and the sheets must be supported such that the ink is not marked or smeared as the sheets are transferred. Typically, such support is provided by skeleton wheels or cylinders mounted to the press delivery drive shaft 54, or as is now more commonly used, net type delivery cylinders such as of the "SUPER BLUE" delivery cylinder system type disclosed in the aforementioned DeMoore patent. More recently, vacuum transfer apparatus of the type disclosed in the aforementioned copending U.S. application Ser. No. 07/630,308 have been used in place of delivery cylinders or skeleton wheels to pull the unprinted side of the sheet away from the delivery drive shaft 54 so that the wet ink surface of the sheets do not come into contact with any press apparatus. It has been found, however, that when a protective or decorative coating material is applied to the wet ink surface of the sheets, the coating protects the wet ink against marking and smearing such that the coating applicator roller itself can be used to support the wet inked surface of the sheets without fear of damage to the freshly printed surface.

In accordance with the present invention, the in-line coating apparatus 10 for selectively applying the protective or decorative coating to the sheets 18 enables the press 12 to be operated in the normal manner without the loss of the final printing station 28, and without requiring any substantial press modifications by employing the existing press delivery drive shaft 54 as the mounting location for the coating applicator roller. In presses 12 utilizing a net type delivery cylinder system, that system can be quickly and easily converted to perform the dual function of being a coating applicator roller and a delivery cylinder. In presses having other types of delivery systems such as skeleton wheels mounted on the delivery drive shaft 54 or a vacuum transfer apparatus as disclosed in the aforementioned copending U.S. application Ser. No. 07/630,308, conversion to a coating operation can be quickly and easily achieved by mounting on the press delivery drive shaft in place of the skeleton wheels or in addition to the vacuum transfer apparatus, a suitable support cylinder capable of performing the combined function of a coating applicator roller and a delivery cylinder 42. Typically, such a support cylinder will have a diameter which provides no more than about a 0.090 inch clearance between the cylinder support surface and the adjacent impression cylinder 36. By utilizing the delivery cylinder 42 mounted on the delivery drive shaft 54 to also act as a coating applicator roller, the present invention insures that the coating will be applied to the printed sheet 18 in precise timed registration, and will permit the press to be operated with its full range of printing stations, yet allow fast, simple and convenient change-over from coating to noncoating operations, and vice versa, with a minimum of press down time.

Figure 2:
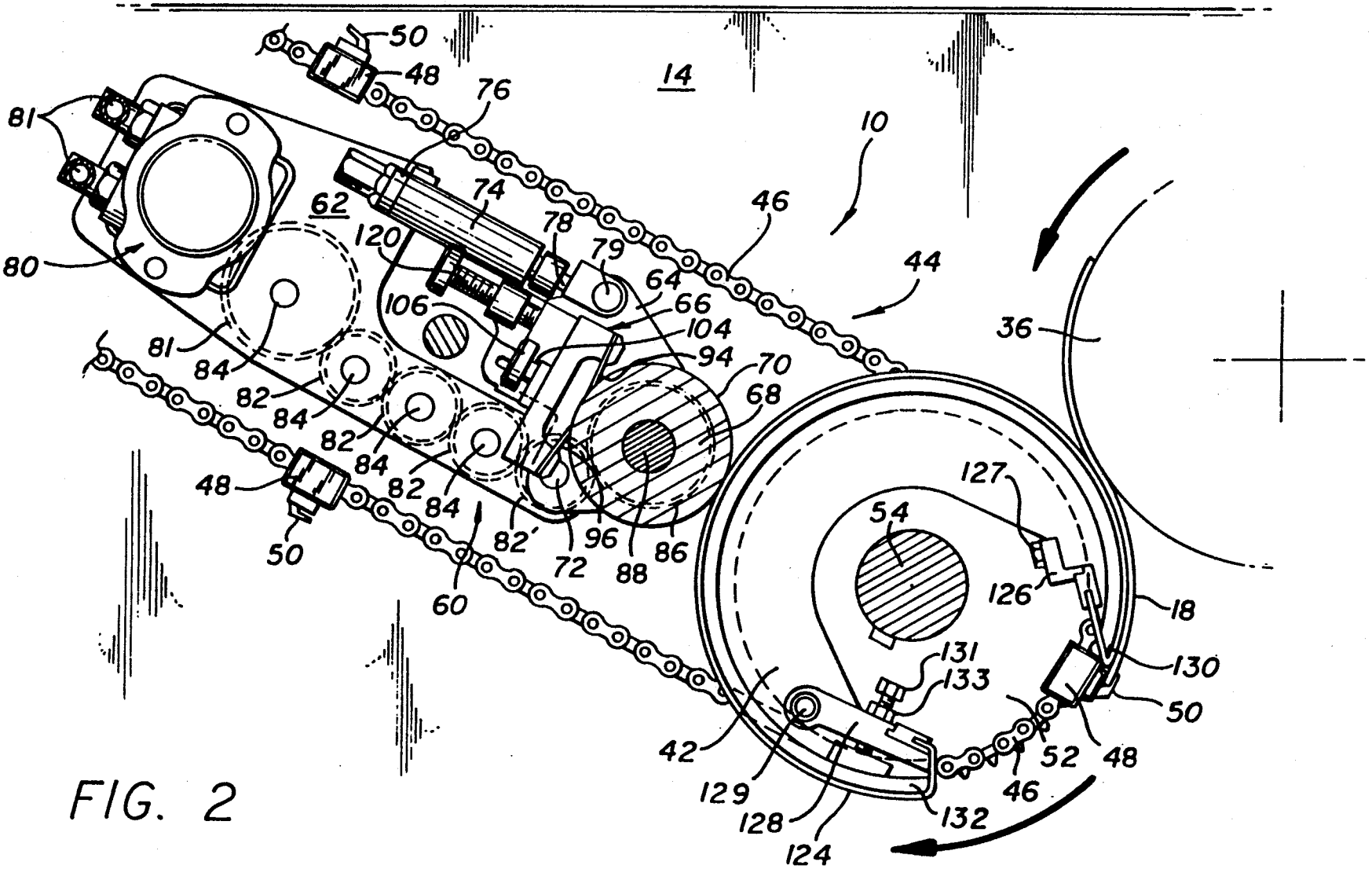
FIG. 2 is an enlarged fragmentary side elevational view taken substantially within the circular area designated "2" in FIG. 1 and showing the coating apparatus of the present invention during coating operation.
Figure 6:
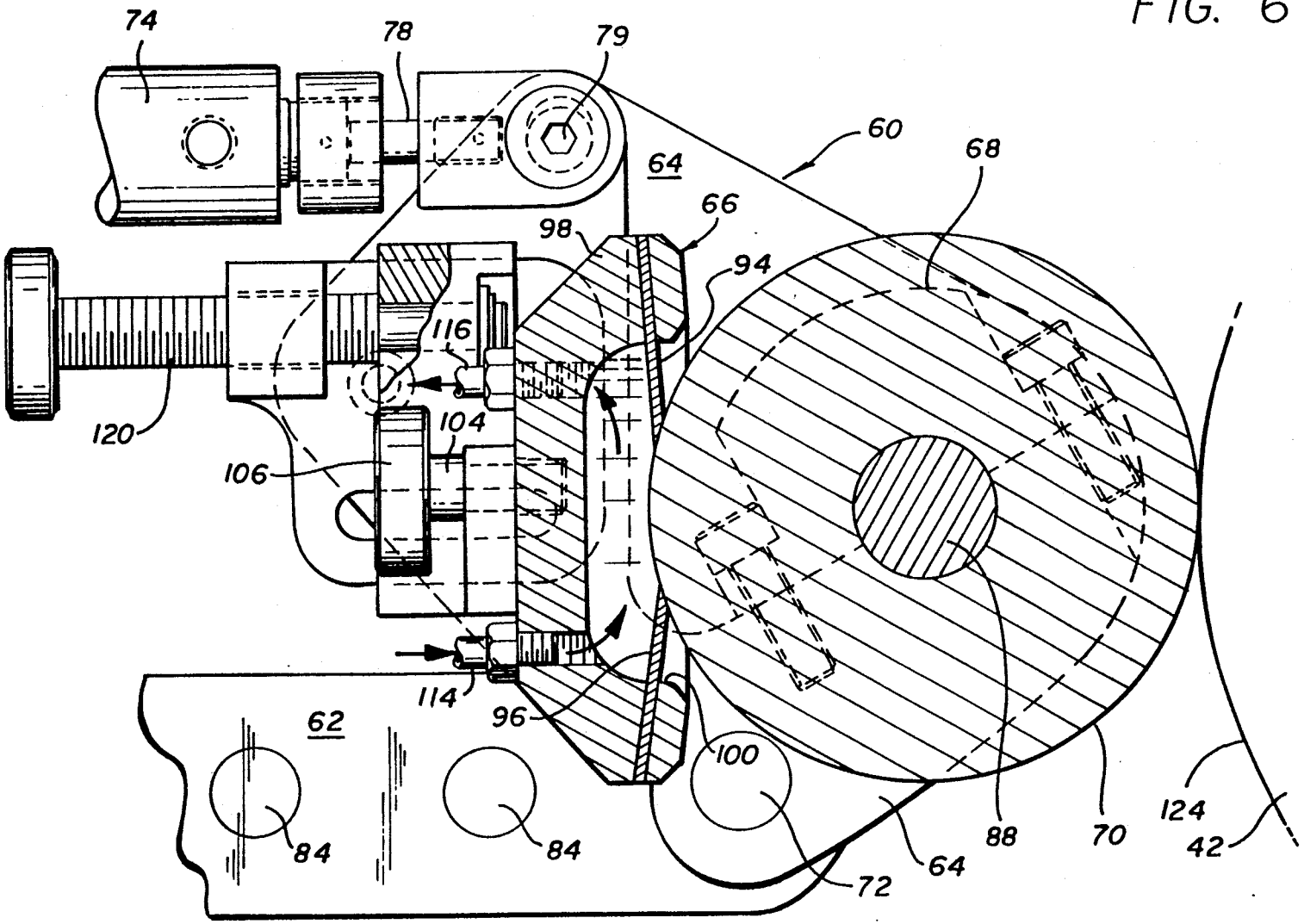
FIG. 6 is an enlarged fragmentary sectional view taken substantially along the lines 6—6 of FIG. 4.

Toward these ends, the coating apparatus 10 of the present invention includes a relatively simple, positive acting and economical coating unit, generally designated 60, mounted to the press frame 14 down stream of the delivery drive shaft 54 and positioned to selectively supply coating material to the support surface of a delivery cylinder 42 mounted on the delivery drive shaft. As best can be seen in FIGS. 2, 4 and 6, the coating unit 60 herein comprises a pair of side frames 62, only one of which is shown, it being understood that the other side frame is substantially the same as that of the side frame illustrated, attached to each side of the press frame 14. Pivotally mounted to one end of each of the side frames 62 is a support bracket 64 carrying one end of a coating material reservoir 66 and cooperating coating material pick-up roller 68 each disposed to extend laterally across the press 12 parallel with the delivery drive shaft 54. The coating unit 60 is mounted between the upper and lower runs of the delivery chains 46 down stream of the delivery drive shaft 54, and positioned so that the outer peripheral surface 70 of the pick-up roller 68 can be frictionally engaged with the support surface of a delivery cylinder 42 mounted on the delivery drive shaft.

Figure 3:
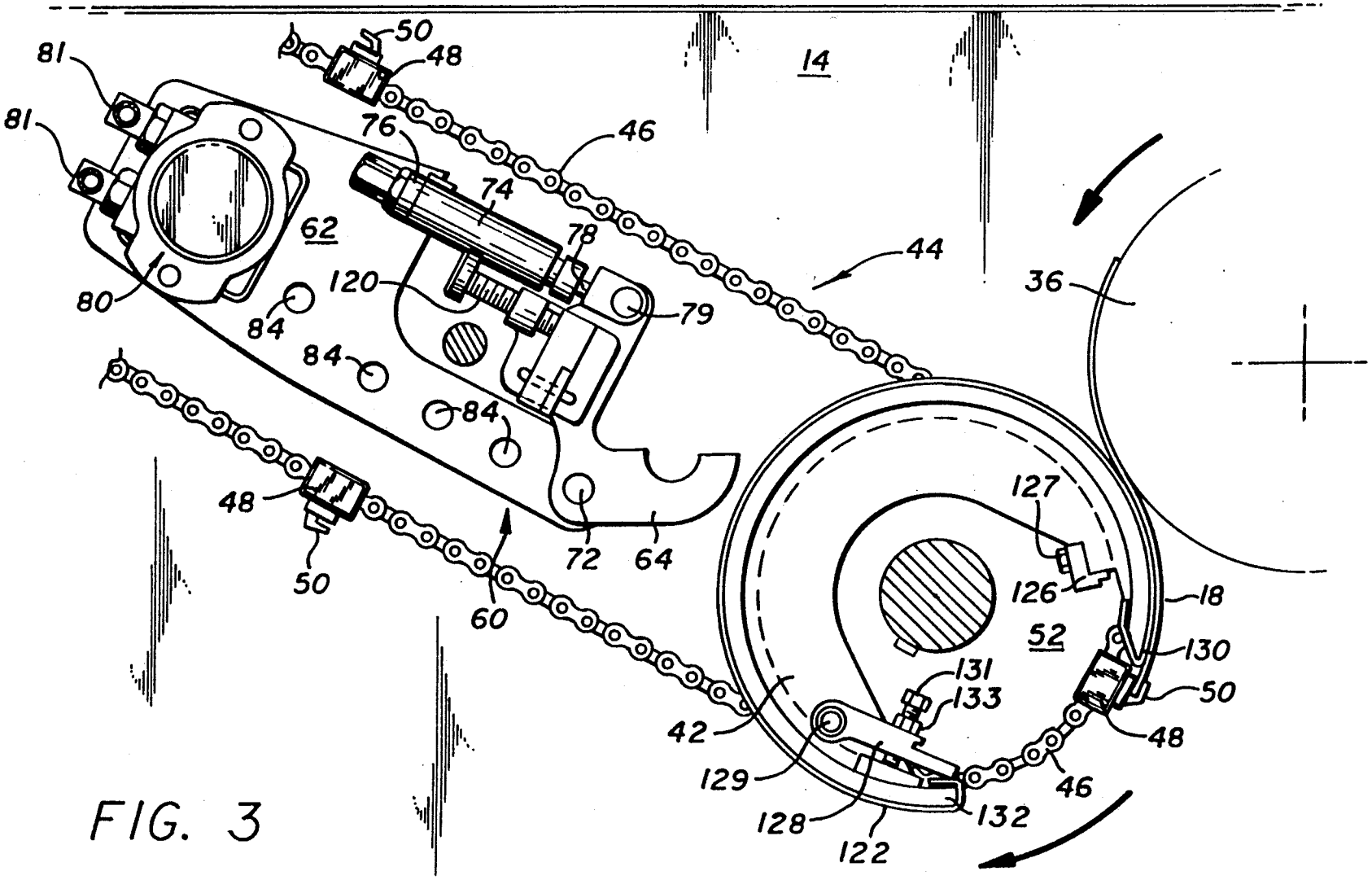
FIG. 3 is a side elevational view similar to FIG. 2, but showing the coating apparatus in the inoperative position with the coating pick-up roller and reservoir removed, and the blanket covering over the delivery cylinder replaced with a fabric net for non-coating printing.

As best seen in FIGS. 2 through 4, the support bracket 64 is pivotally attached to the end of the side frame 62 by a shaft 72 disposed at the lower end portion of the bracket, and can be pivoted about the shaft by an extensible cylinder 74, herein shown as a hydraulic cylinder, one end 76 of which is secured such as by welding to the side frame, and the opposite end 78 of which is coupled through a pivot shaft 79 to the upper end portion of the bracket. By extending or retracting the cylinder 74, the extent of frictional engagement of the pick-up roller 68 with the surface of the delivery cylinder 42 can be controlled, and the pick-up roller can be completely disengaged from the delivery cylinder.

The coating pick-up roller 68, which can be of conventional design and preferably one such as the Anilox rollers manufactured by A.R.C. International of Charlotte, N.C., and sold under the name "PRINTMASTER" having an engraved ceramic or chrome outer peripheral surface 70, is designed to pick up a predetermined uniform thickness of coating material from the reservoir 66, and then uniformly transfer the coating to the support surface of the delivery cylinder 42. To effect rotation of the pick-up roller 68, a suitable motor 80, herein a hydraulic motor, is attached to one of the side frames 62 and coupled to a suitable hydraulic fluid source (not shown) through fittings 81. Attached to the output of the motor 80 is an output gear which is drivingly coupled through a reduction gear 81 and a series of idler gears 82 each mounted on stub axles 84, to a drive gear 86 attached to the end of a shaft 88 on which the pick-up roller 68 is concentrically mounted. The shaft 88 of the pick-up roller 68 is, in turn, journaled at each end to the brackets 64 through a releasable semicircular collar 90 (see FIG. 5) attached by bolts 92 to the bracket. Herein, the axle of the terminal idler gear, designated 82', also serves as the shaft 72 for pivotally mounting the support bracket 64 to the side frame 62 so that when the bracket is rotated about the shaft, the terminal idler gear remains engaged with the drive gear 86 of the pick-up roller 68.

In this instance, as best as can be seen in FIG. 6, the pick-up roller 68 has a portion which projects laterally into the reservoir 66 containing the supply of coating material, and a pair of upper and lower inclined doctor blades 94 and 96 attached to the reservoir engage the roller surface to meter the coating material picked up from the reservoir by the etched surface 70 of the roller. The reservoir 66 herein is formed by an elongated, generally rectangular housing 98 having a generally C-shaped cross-section with a laterally extending opening 100 along one side facing the pick-up roller 68, and is supplied with coating material from a supply tank 102 disposed in a remote location within or near the press 12. Preferably, the reservoir 66 is removably attached to the brackets 64, herein by bolts 104 having enlarged, knurled heads 106, and which can be threaded through slots 108 formed in the brackets to clamp the reservoir in place on the brackets.

To insure that an adequate supply of coating material is always present within the reservoir 66 and to prevent coagulation and clogging of the doctor blades 94 and 96 by the aqueous coating material, the coating material is circulated through the reservoir, herein by two substantially identical pumps 110 and 112, one of which pumps coating material from the supply tank 102 via a supply line 114 to the bottom of the reservoir, and the other of which acts to provide suction to a pair of return lines 116 coupled adjacent the top of the reservoir for withdrawing unused coating material from the reservoir. By circulating the coating material from the supply tank 102 at a greater rate than the rate of withdrawal of material by the pick-up roller 68, a substantially constant supply of coating material will always be present within the reservoir 66.

In this instance, the general arrangement of the pick-up roller 68, doctor blades 94 and 96, and reservoir 66 is substantially like that disclosed in U.S. Pat. No. 4,821,672 entitled DOCTOR BLADE ASSEMBLY WITH ROTARY END SEALS AND INTERCHANGEABLE HEADS", the disclosure of which can be reviewed for details concerning the structure and operation of a pick-up roller and reservoir usable with the present invention.

Once the coating unit 60 has been installed in a press 12, which basically only requires that the side frames 62 be attached, such as with bolts, to the sides of the press frame 14, and the hydraulic motor 80 be coupled with a suitable hydraulic source, the press can be quickly and easily converted to the coating mode. In presses 12 already supplied with a net type delivery cylinder system, to convert to a coating operation, all that is necessary is that the fabric net material (designated 122 in FIG. 3) normally used over the support surface of the net type delivery cylinder during noncoating press operations, be removed and replaced with a coating blanket 124 capable of transferring coating material deposited thereon onto the printed sheets. Typically, such a blanket 124 can be formed as a rubber covering such as used for the covering surface of the conventional blanket cylinders 34 of the press 12. In presses 12 having conventional skeleton wheels or a vacuum transfer type apparatus such as that of the aforementioned copending U.S. application Ser. No. 07/630,308, a suitable delivery cylinder 42 can be fixed to the delivery drive shaft 54 and a similar coating blanket 124 applied thereto over the cylinder surface.

It is important to note that during nonprinting operations, the net type delivery cylinder 42 does not engage the surface of the impression cylinder 36 during sheet delivery. However, when used as a coating applicator roller during coating operations, the effective diameter of the delivery cylinder 42 must be increased so that the coating blanket 124 presses the sheet 18 against the surface of the impression cylinder 36, as shown in FIG. 2. To increase the effective diameter of the delivery cylinder 42, the thickness of the coating blanket 124 applied over the support surface of the delivery cylinder 42 can be selected to correspond with the thickness of the sheets 18 to be printed, or suitable packing sheets, such as paper sheets (not shown) of the type conventionally used in conjunction with press blanket cylinders 34, can be interposed between the delivery cylinder and the coating blanket.

While any suitable means can be used to attached the coating blanket 124 to the support surface of the delivery cylinder 42, in this instance, as shown in FIGS. 2 and 3, the delivery cylinder is supplied with clamps 126 attached by bolts 127 to the cylinder adjacent the leading edge 130 to secure the leading edge of the coating blanket 124 to the cylinder, and adjustable tensioning clamps 128 are provided adjacent the cylinder trailing edge 132 for securing the trailing edge of the blanket to the cylinder. However, the tensioning claims 128 are pivotally mounted at one end by a pin 129 to the cylinder 42, and the blanket tension is adjusted through a bolt 131 and nut 133 arrangement. Depending upon the thickness of the sheets 18 to be printed and coated by the press 12, one or more layers of packing paper or the like may be interposed between the support surface of the delivery cylinder 42 and the coating blanket 124 to increase the effective diameter of the cylinder. Provision of the tensioning clamps 128 for attaching the coating blanket 124 to the leading edge 132 of the delivery cylinder 42 allows for such control and adjustment.

Once installed, the coating unit 60 can remain in position even though the press 12 is operated in the non-coating mode. In this respect, when the coating unit 60 is not in operation, the extensible cylinder 74 can be actuated to pivot the support brackets 64 carrying the pick-up roller 68 and reservoir 66 about the shaft 72 and away from the delivery cylinder 42, thus rendering the coating unit inoperative. This then also frees the pick-up roller 68 and reservoir 66 for fast and easy removal from the coating unit 60 for cleaning, service or replacement. To remove the pick-up roller 68, the coating material is drained from the reservoir 66, and the pressure exerted by the doctor blades 94 and 96 against the roller is released, therein through operation of a pressure adjustment screw 120 attached to the reservoir, and the bolts 92 and collars 90 are removed, thereby permitting the pick-up roller to be lifted from the coating unit 60. To remove the reservoir 66, all that need be done is to release the mounting bolts 104 securing the reservoir to the brackets 64. With the coating unit 60 moved by the extensible cylinder 74 to the inoperative position, the delivery cylinder 42 can be converted for normal delivery cylinder operation simply by removing the coating blanket 124 from the delivery cylinder 42 and replacing the blanket with a fabric net 122. Alternatively, if a vacuum transfer apparatus such as described in the aforementioned copending U.S. application Ser. No. 07/630,308 is installed in the press 12, that apparatus can be activated to deliver sheets from the impression cylinder 36 without effecting any delivery cylinder change since the freshly printed side of the sheets will not come into contact with the delivery cylinder.

In a typical noncoating operation of the press 12 with the coating apparatus 10 installed, the coating unit 60 will be in the inoperative position. In that situation and with a net type delivery cylinder 42 installed, the delivery cylinder will be covered with the fabric net 122 so that the delivery cylinder operates in the normal manner with the wet ink side of the freshly printed sheets 18 being supported by the net covered surface of the delivery cylinder. Should the press 12 include a vacuum transfer apparatus such as disclosed in the aforementioned copending U.S. application Ser. No. 07/630,308, the delivery cylinder 42 can remain on the delivery drive shaft 54, with or without a fabric net 122, depending upon whether or not the press is used for perfector printing.

When it is desired to convert to the coating mode of operation, the press 12 is stopped just long enough to replace the fabric net 122 on the delivery cylinder 42 with the coating blanket 124 packed to the required extent necessary for providing the proper pressure to effect coating of the sheet thickness to be printed. Thereafter, the pumps 110 and 112 are activated and the press 12 re-started. The extensible cylinder 74 can then be activated to control the pressure of the pick-up roller 68 against the delivery cylinder 42 to obtain the desired application of coating material to the freshly printed sheets 18.

Notably, with the coating apparatus 10 of the present invention, no timing adjustments between the delivery cylinder 42 and the impression cylinder 36 are required to achieve and maintain precise registration between application of the coating material and the printed surface of the sheets 18. Further, the coating unit 60 permits a wide range of coating weights to be applied to the printed sheets 18 by quickly and easily changing pick-up rollers 68 from those designed to produce a very light coating application to those designed to produce a very thick coating application can be used.

From the foregoing, it should be apparent that the coating apparatus 10 of the present invention provides a highly reliable, effective and economical in-line apparatus for selectively applying coating material to the freshly printed sheets 18 in a sheet-fed, offset rotary printing press 12 which allows the final printing station to continue to be used as a print station, yet which does not require any substantial press modification or the addition of a separate timed applicator roller. While a particular form of the present invention has been illustrated and described, it should be apparent that variations and modifications therein can be made without departing from the spirit and scope of the invention.

We claim:

1. In a sheet-fed, offset rotary printing press of the type including at least one printing station having a blanket cylinder and an impression cylinder disposed for printing ink onto sheets passing therebetween, and a delivery conveyor system for pulling freshly printed sheets from the impression cylinder and transporting the printed sheets toward a sheet delivery stacker, the delivery conveyor system including a delivery drive shaft disposed adjacent to and extending parallel with the impression cylinder and driven in timed synchronous relation with the impression cylinder, the improvement comprising:

a delivery cylinder mounted to said delivery drive shaft and having an outer peripheral support surface adapted to engage and support a sheet being transported by said delivery conveyor system;

a coating apparatus including a supply of liquid coating material, a rotatable pick-up roller having an outer peripheral surface of substantially cylindrical shape, and means for applying a coating of liquid coating material from said supply onto said outer peripheral surface of said pick-up roller; and means for mounting said coating apparatus to the press adjacent said delivery cylinder including selectively operable means for moving said pick-up roller between a first operable position with a portion of said peripheral surface of said pick-up roller engaged with said support surface of said delivery cylinder, and a second inoperable position with said peripheral surface out of engagement with said support surface of said delivery cylinder, whereby when said pick-up roller is in said first operable position, liquid coating material from said supply applied onto said peripheral surface of said pick-up roller is transferred to said support surface of said delivery cylinder and to said freshly printed sheet.

2. The improvement as set forth in claim 1 wherein said delivery cylinder includes a coating blanket disposed over said peripheral support surface.

3. The improvement as set forth in claim 1 wherein said delivery cylinder includes a removable coating blanket disposed over said peripheral support surface when said pick-up roller is in said first operable position.

4. The improvement as set forth in claim 3 wherein said coating blanket has a rubber outer surface.

5. The improvement as set forth in claim 3 wherein said delivery cylinder includes a fabric net disposed over said peripheral support surface when said pick-up roller is in said second inoperable position.

6. The improvement as set forth in claim 1 wherein said coating apparatus includes an elongated reservoir containing said supply of liquid coating material, said reservoir being disposed to extend parallel with said pick-up roller with a portion of said peripheral surface extending into said reservoir in contact with liquid coating material contained therein, and at least one doctor blade attached to said reservoir and engaging said peripheral surface, said doctor blade acting to limit the amount of liquid coating material applied onto said peripheral surface from said reservoir.

7. The improvement as set forth in claim 6 wherein said reservoir and said pick-up roller are movably coupled to said press and said selectively operable means includes an extensible cylinder coupled between said reservoir and said press and operable to move said reservoir and said pick-up roller between said first and second positions.

8. The improvement as set forth in claim 7 wherein said pick-up roller is rotatably driven by a motor attached to said coating apparatus.

9. The improvement as set forth in claim 8 wherein said delivery cylinder includes a rubber coating blanket disposed over said peripheral support surface when said pick-up roller is in said first operable position, and includes a fabric net disposed over said peripheral support surface when said pick-up roller is in said second inoperable position.

10. The improvement as set forth in claim 9 wherein said coating apparatus is mounted to said press downstream of said delivery drive shaft in the direction of travel of said sheets during transport by said delivery conveyor system.

11. The improvement as set forth in claim 1 wherein said mounting means includes first and second side frames mounted on said press, a support shaft mounted on and extending between said first and second side frames, a support bracket attached to said coating apparatus and movably coupled to said support shaft for pivotal movement between said first and second positions, and said selectively operable means includes an extensible cylinder coupled between said coating apparatus and said support bracket and operable to move said coating apparatus toward and away from said delivery cylinder.

12. In a sheet-fed, offset rotary printing press of the type including at least one printing station having a blanket cylinder and an impression cylinder disposed for printing wet ink onto sheets passing therebetween, and a delivery conveyor system for pulling freshly printed sheets from the impression cylinder and transporting the printed sheets toward a sheet delivery stacker, the delivery conveyor system comprising a pair of endless gripper chains disposed on opposite sides of the press and supporting therebetween gripper bars and grippers spaced along the chains, the gripper chains being driven in timed synchronous relation with the impression cylinder by laterally spaced sprocket wheels mounted on opposite ends of a delivery drive shaft disposed adjacent to and extending parallel with the impression cylinder, the improvement comprising:

a delivery cylinder mounted to said delivery drive shaft between said sprocket wheels and having an outer peripheral support surface covered by a removable coating blanket adapted to engage and support the wet ink side of a sheet being transported by said gripper bars;

a coating apparatus including a supply of liquid coating material, a rotatable pick-up roller having an outer peripheral surface of substantially cylindrical shape communicating with said supply, and means for applying liquid coating material from said supply onto said peripheral surface of said pick-up roller; and, means for mounting said coating apparatus to the press adjacent the delivery cylinder, said means including selectively operable means for moving said coating apparatus between a first operable position with a portion of said peripheral surface of said pick-up roller engaged with said delivery cylinder, and a second inoperable position with said peripheral surface of said pick-up roller out of engagement with said delivery cylinder, whereby when said coating apparatus is in said first operable position, liquid coating material from said supply metered onto said peripheral surface of said pick-up roller is transferred to said delivery cylinder and to said freshly printed sheet, and when said coating apparatus is in said second inoperable position, said delivery cylinder is disposed for non-coating sheet delivery operation.

13. The improvement as set forth in claim 12 wherein the effective diameter of said delivery cylinder covered by said coating blanket is sufficient to apply pressure to sheets against said impression cylinder as said sheets are pulled from said impression cylinder by said gripper bars.

14. The improvement as set forth in claim 13 wherein said coating blanket has a rubber outer support surface.

15. The improvement as set forth in claim 14 wherein said coating apparatus is disposed downstream of said delivery drive shaft in the direction of travel of said sheets during transport by said delivery conveyor system.

16. A sheet-fed, offset rotary printing press including:

at least one printing station having a blanket cylinder and an impression cylinder disposed for printing wet ink onto sheets passing therebetween;

a delivery conveyor system for pulling freshly printed sheets from the impression cylinder and transporting the printed sheets toward a sheet delivery stacker, the delivery system including a delivery drive shaft;

a delivery cylinder mounted to said delivery drive shaft and having an outer peripheral support surface adapted to engage and support a sheet being transported by said delivery conveyor system;

a coating apparatus including a supply of liquid coating material, a rotatable pick-up roller having an outer peripheral surface of substantially cylindrical shape communicating with said supply, and means for applying liquid coating material from said supply onto said peripheral surface of said pick-up roller; and means for mounting said coating apparatus to the press adjacent said delivery cylinder, said means including selectively operable means for moving said pick-up roller between a first operable position with a portion of said peripheral surface of said pick-up roller engaged with said delivery cylinder, and a second inoperable position with said peripheral surface of said pick-up roller out of engagement with said delivery cylinder, whereby when said pick-up roller is in said first operable position, liquid coating material from said supply applied to said peripheral surface of said pick-up roller is transferred to said delivery cylinder and then to said freshly printed sheet.

17. A sheet-fed, offset rotary printing press as set forth in claim 16 wherein said delivery cylinder includes a removable coating blanket disposed over said peripheral support surface when said pick-up roller is in said first operable position.

18. A sheet-fed, offset rotary printing press as set forth in claim 17 wherein said coating blanket has a rubber outer surface.

19. A sheet-fed, offset rotary printing press as set forth in claim 17 wherein said delivery cylinder includes a fabric net disposed over said peripheral support surface when said pick-up roller is in said second inoperable position.

20. A sheet-fed, offset rotary printing press as set forth in claim 19 wherein said coating apparatus includes an elongated reservoir containing said supply of liquid coating material, said reservoir being disposed to extend parallel with said pick-up roller with a portion of said peripheral surface extending into said reservoir in contact with liquid coating material contained therein, and at least one doctor blade attached to said reservoir and engaging said peripheral surface, said doctor blade acting to limit the amount of liquid coating material applied onto said peripheral surface from said reservoir.

21. A sheet-fed, offset rotary printing press as set forth in claim 20 wherein said selectively operable means includes an extensible cylinder coupled between said reservoir and said press and operable to move said reservoir and said pick-up roller laterally between said first and second positions.

22. A sheet-fed, offset rotary printing press as set forth in claim 21 wherein said pick-up roller is rotatably driven by a motor attached to said coating apparatus.

* * * * *